US009945076B2

(12) United States Patent
Choi et al.

(10) Patent No.: US 9,945,076 B2
(45) Date of Patent: Apr. 17, 2018

(54) METHOD OF PRODUCING A CREPING PAPER AND THE CREPING PAPER THEREOF

(71) Applicant: Solenis Technologies, L.P., Schaffhausen (CH)

(72) Inventors: Doeung David Choi, Hockessin, DE (US); Davit E Sharoyan, Hockessin, DE (US); Jeffrey Allan Tunell, Hockessin, DE (US)

(73) Assignee: Solenis Technologies, L.P., Wilmington, DE (US)

( * ) Notice: Subject to any disclaimer, the term of this patent is extended or adjusted under 35 U.S.C. 154(b) by 34 days.

(21) Appl. No.: 14/965,932

(22) Filed: Dec. 11, 2015

(65) Prior Publication Data

US 2016/0168798 A1 Jun. 16, 2016

Related U.S. Application Data

(60) Provisional application No. 62/091,218, filed on Dec. 12, 2014.

(51) Int. Cl.

| | |
|---|---|
| ***B31F 1/12*** | (2006.01) |
| ***D21H 21/14*** | (2006.01) |
| ***D21H 27/00*** | (2006.01) |
| ***D21H 17/70*** | (2006.01) |
| ***D21F 5/02*** | (2006.01) |

(52) U.S. Cl.

CPC ..... *D21H 21/146* (2013.01); *B31F 1/12* (2013.01); *D21F 5/02* (2013.01); *D21H 17/70* (2013.01); *D21H 27/002* (2013.01)

(58) Field of Classification Search

CPC ..... D21H 21/146; D21H 17/35; D21H 17/55; D21H 25/005; D21H 17/52; D21H 17/72; D21H 21/02; D21H 25/04; D21H 27/002; B31F 1/12; D21F 3/00; D21F 5/02

See application file for complete search history.

(56) References Cited

U.S. PATENT DOCUMENTS

| | | | | |
|---|---|---|---|---|
| 5,658,374 | A * | 8/1997 | Glover | B29C 33/60 106/173.01 |
| 5,660,687 | A | 8/1997 | Clungeon et al. | |
| 6,139,911 | A * | 10/2000 | Vanhecke | C10M 173/00 106/2 |
| 7,404,875 | B2 | 7/2008 | Clungeon et al. | |
| 7,744,722 | B1 * | 6/2010 | Tucker | B31F 1/126 156/183 |
| 8,101,045 | B2 | 1/2012 | Furman et al. | |
| 8,147,649 | B1 | 4/2012 | Tucker et al. | |
| 8,608,904 | B1 | 12/2013 | Tucker et al. | |
| 8,865,263 | B2 * | 10/2014 | Sharoyan | D21F 3/02 106/38.24 |
| 8,883,890 | B2 | 11/2014 | Sekiya et al. | |
| 9,267,239 | B2 * | 2/2016 | Dilkus | D21H 17/35 |
| 9,611,590 | B2 * | 4/2017 | Ringold | D21H 21/146 |
| 2004/0211534 | A1 | 10/2004 | Clungeon et al. | |
| 2005/0245669 | A1 * | 11/2005 | Clungeon | C09J 133/26 524/515 |
| 2006/0207736 | A1 * | 9/2006 | Boettcher | D21H 21/146 162/112 |
| 2007/0000630 | A1 | 1/2007 | Hassler et al. | |
| 2010/0184902 | A1 * | 7/2010 | Boettcher | D21H 21/146 524/417 |
| 2011/0162811 | A1 | 7/2011 | Furman et al. | |
| 2011/0297341 | A1 * | 12/2011 | Dilkus | D21H 17/35 162/111 |
| 2015/0122433 | A1 * | 5/2015 | Ringold | D21H 21/146 162/111 |
| 2015/0159329 | A1 * | 6/2015 | Tan | D21H 17/55 162/111 |
| 2015/0176212 | A1 * | 6/2015 | Townsend | B31F 1/126 162/111 |
| 2015/0176213 | A1 * | 6/2015 | Dilkus | D21H 17/35 162/111 |
| 2016/0168798 | A1 * | 6/2016 | Choi | D21F 5/02 162/111 |
| 2017/0204565 | A1 * | 7/2017 | Ringold | D21H 21/146 |

FOREIGN PATENT DOCUMENTS

| | | | | |
|---|---|---|---|---|
| WO | 2011058086 | 5/2011 | | |
| WO | WO 2016094754 A1 * | 6/2016 | | D21F 5/02 |

OTHER PUBLICATIONS

The International Bureau of WIPO, International Preliminary Report on Patentability for International Application No. PCT/US2015/065157 dated Jun. 22, 2017.

* cited by examiner

*Primary Examiner* — Jose A Fortuna

(74) *Attorney, Agent, or Firm* — LKGlobal | Lorenz & Kopf, LLP

(57) ABSTRACT

The present invention provides for a method of producing a creped paper and the crepe paper products made using this method. The method includes treating the surface of a crepe fiber web and/or surface of a Yankee drum dryer or cylinder with compositions containing a combination of hydrophobes and surfactants and wherein these compositions have been subjected to physical treatments to reduce the mean particle size to about 1 micron (μm) or less.

19 Claims, 6 Drawing Sheets

Photomicrographs of the surface of the creped sheets

METHOD OF PRODUCING A CREPING PAPER AND THE CREPING PAPER THEREOF

This application claims the benefit of U.S. provisional application No. 62/091,218, filed 12 Dec. 2014, the entire contents of which are hereby incorporated by reference.

FIELD OF THE INVENTION

The present invention provides for a method of producing a creped paper and the crepe paper products made using this method. The method includes treating the surface of a crepe fiber web and/or surface of a Yankee drum dryer or cylinder with compositions containing a combination of hydrophobes and surfactants and wherein these compositions have been subjected to physical treatments to reduce the mean particle size to about 1 micron (μm) or less.

BACKGROUND

A crepe paper having crepes, such as tissue paper or toilet paper, is produced by pressing a crepe fiber web against the surface of a heated cylindrical dryer, called a Yankee dryer or Yankee cylinder, which terms will be used interchangeably, so that the crepe fiber web adheres thereto, followed by drying, and then stripping the crepe fiber web or crepe paper from the Yankee dryer using a doctor blade.

In order to form a high-quality crepe paper, the adhesion and strip ability of the crepe fiber web or crepe paper to and from the heated cylindrical dryer are important, and the degrees thereof greatly influence the crepe configuration.

Creping is an important operation in making paper products such as, tissue and towel products. Creping generates softness and necessary void space in tissue and towel products for desirable absorbency. In modern creping operations, it is typical to use compositions comprising adhesives, release agents, modifiers and plasticizers to aid creping operations on a high speed creping machine. The compositions when applied to the surface of a Yankee cylinder or dryer, which terms will be used interchangeably, ensures the wet paper web is transferred smoothly to the hot Yankee dryer. Good adhesion is necessary for the wet paper web to transfer to the Yankee dryer surface. Good adhesion also helps faster drying of the wet paper web by the steam heated Yankee dryer and hot air from an overhead hood. A proper surface application provides adequate adhesion for easy transfer of the wet paper web onto the Yankee cylinder surface.

Once the crepe fiber web on the Yankee cylinder surface is dried, the crepe paper is creped off from the Yankee cylinder surface using a doctor blade. The adhesion should be enough to generate a good crepes structure that will give good handfed properties to the final paper product. However, the adhesion should not be too much that it will hinder the paper web from being creped off from the Yankee cylinder by the doctor blade.

The hardness of the composition used in coating the surface of the Yankee dryer should be in the desirable range. If it is too soft, the surface coating would not be able to protect the Yankee dryer surface from the metal doctor blade. If composition is too hard, the coating on the surface of the Yankee cylinder could start building up causing sheet breaks. A good coating applied to the surface of the Yankee cylinder should provide an optimum range of hardness.

Mills typically use adhesives and release agents in combination to control adhesion of the paper web to the surface of the Yankee cylinder and use one or more modifiers to control the hardness of composition used in coating the surface of the Yankee dryer.

Mills have found using three or more components makes the Yankee creping operation quite complicated. Therefore, tissue and towel manufacturers typically try to use only two agents to control adhesion and hardness of the composition applied to the surface of the Yankee dryer.

Many different hydrophobic materials have been used to improve the release of a paper web from a Yankee cylinder. For example, WO 2011/058086 by Jansen et al talks about application of $C_{16}$-$C_{20}$ fatty acids and their salts to a Yankee cylinder to facilitate paper web release from said cylinder. U.S. Pat. No. 7,404,875 by Clugeon, teaches about creping adhesive composition with modifier component comprising limonene. US 2013/0048238 by Glover et al teach the application of oil-based formulations for creping release comprising at least one vegetable oil, at least one lecithin and at least one dispersant/emulsifier. Hydrophobic materials such as naphthenic, paraffinic, vegetable, mineral or synthetic oils and emulsifying surfactants such as fatty acids, alkoxylated alcohols, alkoxylated fatty acids, alkoxylated fatty acids are mentioned as release aids for creping process by Furman et al in U.S. Pat. No. 8,101,045. The application US 2007/0000630 by Hassler, et al. disclose a crepe facilitating composition comprising at least one water-insoluble, non-surface active thermoplastic material having a softening or melting point within a range of 40° C. to 100° C. The list of water-insoluble thermoplastic materials includes montan waxes, paraffin waxes, oxidized waxes, microcrystalline waxes, Carnauba wax, and synthetic waxes produced by Ficher-Trops process.

In addition to hydrophobic agents a wide range of hydrophobic alcohols, glycols, polyethers have been used as creping release agents. For example, U.S. Pat. No. 5,660,687 by Allen et al teaches on creping release aids selected from the group of ethylene glycol, glycerol, propylene glycol, di- and tri-ethylene glycols, dipropylene glycol, polyalkanolamines, aromatic sulfonamides, pyrrolidone and mixtures thereof. The application US 2004/0211534 by Clugeon, et al. talks about application of creping modifier comprising polyoxyalkylene polymers, specifically polyoxypropylene ethers of saturated fatty alcohols. And more recently US 2014/0190644 by Townsend discloses the use of creping release agents comprising a quaternary imidazoline compound, an imidazoline free base, an oil-based dispersion or a combination thereof and a polyether component selected from polypropylene glycol, copolymer or blend of propylene glycol and ethylene glycols.

U.S. Pat. No. 7,744,722 by Tucker et al teaches about application of creping modifier comprising polyethylene to the surface of creping cylinder. The creping modifier further comprises mineral oil, cationic and non-ionic surfactants. U.S. Pat. No. 8,608,904 and U.S. Pat. No. 8,147,649 by the same authors expand the teaching onto applications including oxidized polyethylene in combination with mineral oil and surfactants.

All references mentioned above describe release compositions made by simple blending or emulsification of its components. U.S. Pat. No. 8,883,890 teaches the creping agent formulation comprising nitrogen containing inorganic solid lubricants, e.g. boron nitride and silicon nitride with a particle size of 0.5 to 20 μm. However, the '890 patent teaches that lubricity of creping layer becomes insufficient when the particle size of the lubricant is less than 0.5 μm.

The inorganic solid lubricant is dispersed in a creping agent composition at a concentration limited to 0.1 to 5.0% by mass.

The present method teaches the creping properties of a micro-emulsion of a release agent and modifier agent improve upon reduction in particle size. Additionally, the release agents in the present method are stable in a wide range of creping formulations, for example, the hydrophobic agent(s) can range from 0 to about 90% by wt., and can be from about 10% to about 50% by weight of the micro-emulsion.

In addition, the composition should provide good tissue making operation including creping. As mentioned above, if there is a coating or composition buildup, a non-uniform coating, or dryer edge build up, the creping operation could be disrupted.

The present method provides a method for improvement of creping in the manufacturing of creped products such as tissue and towel making processes. It also relates to a single emulsified product of creping release and creping modifier that may contain combination of two or more hydrophobes as well as anionic and non-ionic surfactants.

SUMMARY OF THE INVENTION

The current invention relates to a method wherein a micro-emulsion is prepared wherein at least one release agent and at least one modifier agent are combined to form a single micro-emulsion product. The release and modifier agents are subjected to an emulsifying means, such as high pressure and/or sheer to generate a micro-emulsion wherein the particle size is about 1 micron (μm) or less as measured by a Horiba Particle Size Analyzer LA 300. The micro-emulsion of release and modifier agents not only makes the creping operation less complex, but also improves efficiency of creping and creped web properties.

In order to provide desirable handfeel and sheet properties, the composition applied to the surface of the crepe Yankee cylinder requires the proper level of adhesion and hardness after it is applied to the surface. The composition needs to provide good creping properties while being hard enough to protect the Yankee cylinder surface from the metal doctoring blade.

Disclosed is a method that provides the proper levels of adhesion and hardness of the composition applied to the surface of a Yankee dryer and provides for further improvement of efficiency and effectiveness of the creping process.

The current method also relates to a surface treatment of a crepe fiber web and/or a Yankee cylinder wherein the surface(s) are treated with a composition comprising an adhesive, a micro-emulsified release and modifier agent and optionally a plasticizer, wherein the release agent and modifier agent are combined and homogenized under high pressure and/or shear to produce a micro-emulsion.

In a typical creping operation, additives used in the surface treatment of the Yankee cylinder, need to be emulsified by typical means in the industry such as use of a mixing tank or inline mixer. What we have found is that if the release and modifier agents are homogenized into a micro-emulsion, there performance is significantly improved. By micro-emulsion we mean that the combination of the at least one release agent and the at least one modifier agent is subjected to enough external force, such as high pressure and/or high shear, which results in a homogenization of the two or more components resulting in a single emulsion having a mean particle size of 1 micron or less.

When the release agent and modifier agent are homogenized into a micro-emulsion, a significant improvement in the efficiency of creping process is realized when compared with the case where the release agent and modifier agent are simply mixed together before application or when they are applied separately.

In addition, the homogenization of release agent and modifier agent into a micro-emulsion affects the creping process to generate a desirable structure of the final tissue product that results in improved handfeel.

In some embodiments, the surface treatment of the crepe fiber web and/or Yankee cylinder with the micro-emulsion of release and modifier agent remains doctorable in a wide operation temperature and as a result, Yankee dryer operates clean during creping operation.

DETAILED DESCRIPTION

Figure 1:
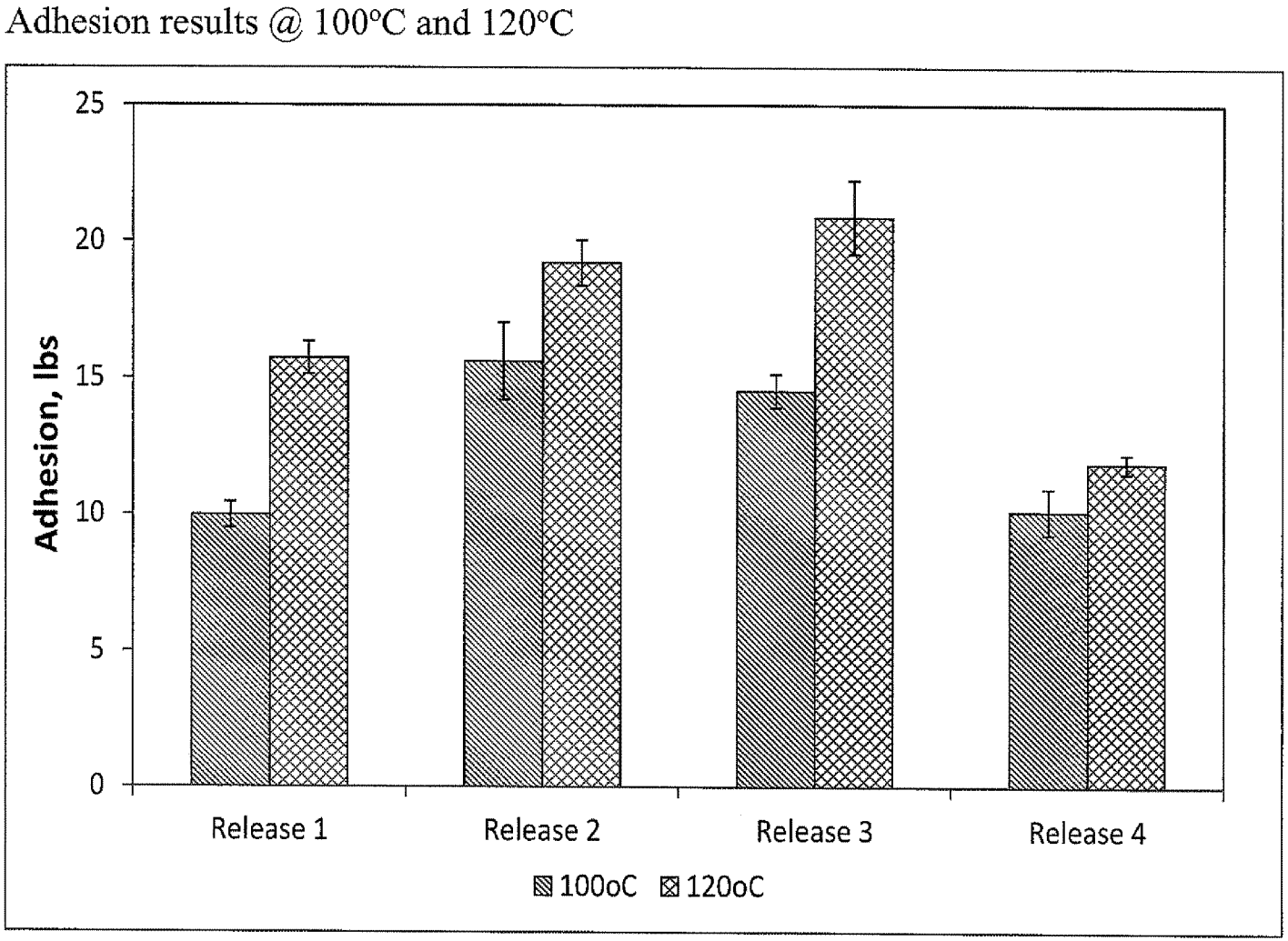
FIG. 1 are Adhesion release results @ 100° C. and 120° C.

The present invention in one aspect relates to a method for manufacturing a crepe paper product, wherein a composition comprising at least one of a creping adhesive, release agent, modifier agent and optionally plasticizer, is applied to the surface of the crepe fiber web and/or a Yankee drum dryer or cylinder. The release agent and modifier agent are combined and/or separately homogenized under high pressure and/or shear to produce a micro-emulsion, which is then farther diluted before it is applied to the surface of the crepe fiber web and/or surface of the Yankee cylinder. Application of the various chemicals to the surface of the crepe fiber web and/or Yankee cylinder can be done using typical techniques in the industry such as spray and puddle methods. The adhesive and optional plasticizer can be applied to the surface of the crepe fiber web and/or Yankee cylinder separately or together. They can also be applied to the surfaces prior to, simultaneously with, subsequent to, or in combination with the micro-emulsion resulting in enhanced release and improved creped fiber web quality. When we say the adhesive and optional plasticizer can be applied in combination with the micro-emulsion, we mean the adhesive(s) and optional plasticizer(s) can be combined/mixed with the micro-emulsion of release agent and modifier agent prior to the chemicals being applied to the surface of the crepe fiber web or Yankee cylinder.

In one aspect, the micro-emulsion of the release agent and modifier agent can have an mean particle size of less than 1 micron (μm), can be less than about 500 nanometer (nm), and may be less than about 300 nm.

In another aspect, the micro-emulsion of the release and modifier agents comprises one or more compounds selected from hydrophobic materials, nonionic surfactants, anionic surfactants, and mixtures of thereof.

In another aspect, the hydrophobic materials are selected from the group consisting of mineral oil, vegetable oil, fatty acid esters, natural or synthetically derived hydrocarbon, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, polyethylene homo polymers, oxidized polypropylene homopolymers, oxidized polyethylene homopolymers and combinations thereof.

In another aspect, the release agent/modifier agent micro-emulsion comprises a fatty acid tri-ester, synthetically derived hydrocarbon, anionic surfactants and/or linear ethoxylated alcohol.

In yet another aspect, the fatty acid tri-ester component of the micro-emulsion ranges from about 30% to about 99% by wt. total solids of the micro-emulsion.

In another aspect, the synthetically derived hydrocarbon of the micro-emulsion can range from 0% to about 90% by wt. total solids of the micro-emulsion.

In another aspect, the micro-emulsion can be a mixture comprising mineral oil, synthetically derived hydrocarbon, anionic surfactants and/or linear ethoxylated alcohol.

In yet another aspect, the micro-emulsion can be an nonionic surfactant selected from the group consisting of linear alcohol ethoxylated, branched alcohol ethoxylated, polyethylene glycol mono or diester fatty acid, polyethylene glycol alkyl ether and combinations thereof.

In another aspect, the micro-emulsion can be an anionic surfactant selected from the group consisting of sodium dioctylsulfosuccinate, sodium dodecylbenzenesulfonate, sodium lauryl sulfate and combinations thereof.

In yet another aspect, the creping adhesive can be selected from the group consisting of a thermosetting resin, a non-thermosetting resin, a polyamide resin, a polyaminoamide resin, polyvinylamine, a glyoxylated polyacrylamide resin, a film-forming semi-crystalline polymer, hemicellulose, carboxymethyl cellulose, polyvinyl alcohol, an inorganic cross-linking agent or combinations thereof.

In another aspect, the release efficiency of the creped fiber web from the Yankee cylinder is improved by at least about 10% when using the homogenized micro-emulsion of the present invention compared with a similar process wherein the release agent is simply mixed with a modifier agent prior to applying the mixture to the surface of the Yankee dryer, without being emulsified under high pressure and shear.

In another aspect, the creping adhesive and micro-emulsion of release and modifier agents are mixed together before the chemicals are applied to the surface of the crepe fiber web and/or the Yankee dryer.

In yet another aspect, the creping adhesive and the micro-emulsion of release and modifier agents are applied separately to the surface of the crepe fiber web and/or the Yankee dryer.

In another aspect, the micro-emulsion of release and modifier agent and/or creping adhesive is first applied to the fibrous web, wherein the micro-emulsion of release and modifier agent and/or creping adhesive is transferred to the surface of the Yankee dryer on pressing the fibrous web against the surface of the Yankee dryer.

The results obtained by the current method is enhanced efficiency in creping release by combining a hydrophobic reagent and a surfactant, or a combination thereof and subjecting the mixture to physical and/or chemical treatments in order to reduce the particle size of the generated emulsion.

One method of generating the micro-emulsion would be by combining hydrophobic agent(s) and surfactant(s) and subjecting them to an increased pressure and shear. There are various units that can be used to generate the micro-emulsion, such as, but not limited to, homogenizers or a microfluidizer. As a result of the high pressure, high shear and/or agitation, a micro-emulsion having a mean particle size of less than a micron (nano-scale) can be generated. By generating so called micro- or nano-emulsions and applying them as a creping release aid/modifier in a Yankee creping process, the paper web release efficiency of the crepe paper from the Yankee cylinder significantly increases.

EXAMPLES

The micro-emulsion of the present method was evaluated for their ability to reduce adhesion of creping adhesives. A number of typical release agents and combinations of release agent and modifier agent were tested on an Adhesion/Release tester and the crepe simulator creping tester to measure their affects on adhesion of coating, on creping performance and sheet crepe properties. The micro-emulsion of the present method was tested in combination with creping adhesives in an aqueous solution of 2% creping adhesive and 1% single emulsion product, commercial release agent or in combination of release and modifier agents mixed together right before the use.

Example #1

Reduction in Adhesion

The following compositions were evaluated for their ability to reduce adhesion of the crepe paper to the Yankee cylinder during a creping operation. The compositions outlined in Table 1, were tested on an Adhesion Release tester (ART) designed by Hercules Inc. to measure the effects of the compositions on adhesion force (see Choi, D. D., "Systematic Investigations Help Pave Way for Yankee Dryer Coating Optimization," Proceedings, 2005 Tissue World Conference at Miami, 2005). A 3% solids aqueous solution comprising a typical crepe adhesive, release agent and modifier were used in this evaluation (Table 1). The composition of creping aid systems that were evaluated were as follows:

TABLE 1

Composition of creping aids system

| Example | Adhesive | Release Aid | Modifier |
|---|---|---|---|
| 1 | Crepetrol 9730 | Release 1 | Yes |
| 2 | Crepetrol 9730 | Release 2 | No |
| 3 | Crepetrol 9730 | Release 3 | No |
| 4 | Crepetrol 9730 | Release 4 | Yes - Micro-emulsion |

Release 1 is a commercial release product wherein the hydrophobic material is a fatty acid tri-ester. Release 2 and 3 are commercial release products of which main hydrophobic material is mineral oil. The modifier is a synthetically derived hydrocarbon and a surfactant. Release 4 is a micro-emulsion of the fatty acid tri-ester of Release 1 and modifier agent.

The creping aid system tested comprised about 60% PAE Resin, about 7% plasticizer, about 30% release agent and about 3% modifier by weight.

The results showed that the micro-emulsion as used in Release 4 effectively reduced adhesion of the adhesive (Crepetrol 9730) as much as the reference dual addition release modifier system (Release 1 and Modifier) and reduced adhesion significantly more than Release 2 and Release 3, without the modifier. At 120° C., Release 4 reduced the adhesion of the paper web to the Yankee cylinder significantly more than the reference release modifier system and Release 1 and Release 2 (see Table 2 and FIG. 1).

TABLE 2

| Adhesion Release Test results (unit: psi) | | | | | | |
|---|---|---|---|---|---|---|
| | | | Adhesive @100° C. | | Adhesive @120° C. | |
| Adhesive | Release Aid | Modifier | Average | Standard | Average | Standard |
| Crepetrol 9730 | Release 1 | Yes | 9.97 | 0.47 | 15.73 | 0.60 |
| Crepetrol 9730 | Release 2 | No | 15.61 | 1.41 | 19.21 | 0.82 |
| Crepetrol 9730 | Release 3 | No | 14.54 | 0.61 | 20.89 | 1.37 |
| Crepetrol 9730 | Release 4 | Yes Micro-emulsion | 10.11 | 0.85 | 11.89 | 0.34 |

Example #2

Creping Efficiency

The micro-emulsion was also evaluated for their ability to improve creping operation. The compositions outlined in Table 3, were tested on a Crepe Simulator designed by Hercules Inc to measure the affects of the compositions on adhesion force (see Choi, D. D., "Cutting papermaker risk," Paper 360°, February 2008). A 3% solids aqueous solution of a creping aid system comprising a crepe adhesive, release agent and modifier agent were sprayed onto the surface of a Yankee dryer in the crepe simulator. The creping aid system tested comprised about 60% PAE Resin, about 7% plasticizer, about 30% release agent and about 3% Modifier by weight.

TABLE 3

| Compositions of creping aid system. | | | |
|---|---|---|---|
| Example | Adhesive | Release | Modifier |
| 1 | Crepetrol 9730 | Release 1 | Yes |
| 2 | Crepetrol 9730 | Release 2 | No |
| 3 | Crepetrol 9730 | Release 3 | No |
| 4 | Crepetrol 9730 | Release 4 | Yes-Micro-emulsion |

Release 1/modifier: sheet creped with adhesive (Crepetrol 9730), fatty acid tri-ester base release and modifier mixed together before spray. Release 2: sheet creped with adhesive (Crepetrol 9730) and one commercial mineral oil release. Release 3: sheet creped with adhesive (Crepetrol 9730) and another commercial mineral oil release (Release 3). Release 4: sheet creped with adhesive (Crepetrol 9730) and micro-emulsion of the fatty acid tri-ester of release 1 and modifier using high pressure and high mechanical energy.

TABLE 4

| Crepe performance results of creping aid system. | | | | | | |
|---|---|---|---|---|---|---|
| | | | Stretch (%) | | Crepe Force (N) | |
| Adhesive | Release Aid | Modifier | Average | Standard | Average | Standard |
| Crepetrol 9730 | Release 1 | Yes | 35 | 0.72 | 39.57 | 1.37 |
| Crepetrol 9730 | Release 2 | No | 35 | 1.25 | 41.27 | 1.75 |
| Crepetrol 9730 | Release 3 | No | 38 | 2.50 | 45.37 | 5.27 |
| Crepetrol 9730 | Release 4 | Yes Micro-emulsion | 33 | 0.72 | 36.00 | 0.36 |

Figure 2:
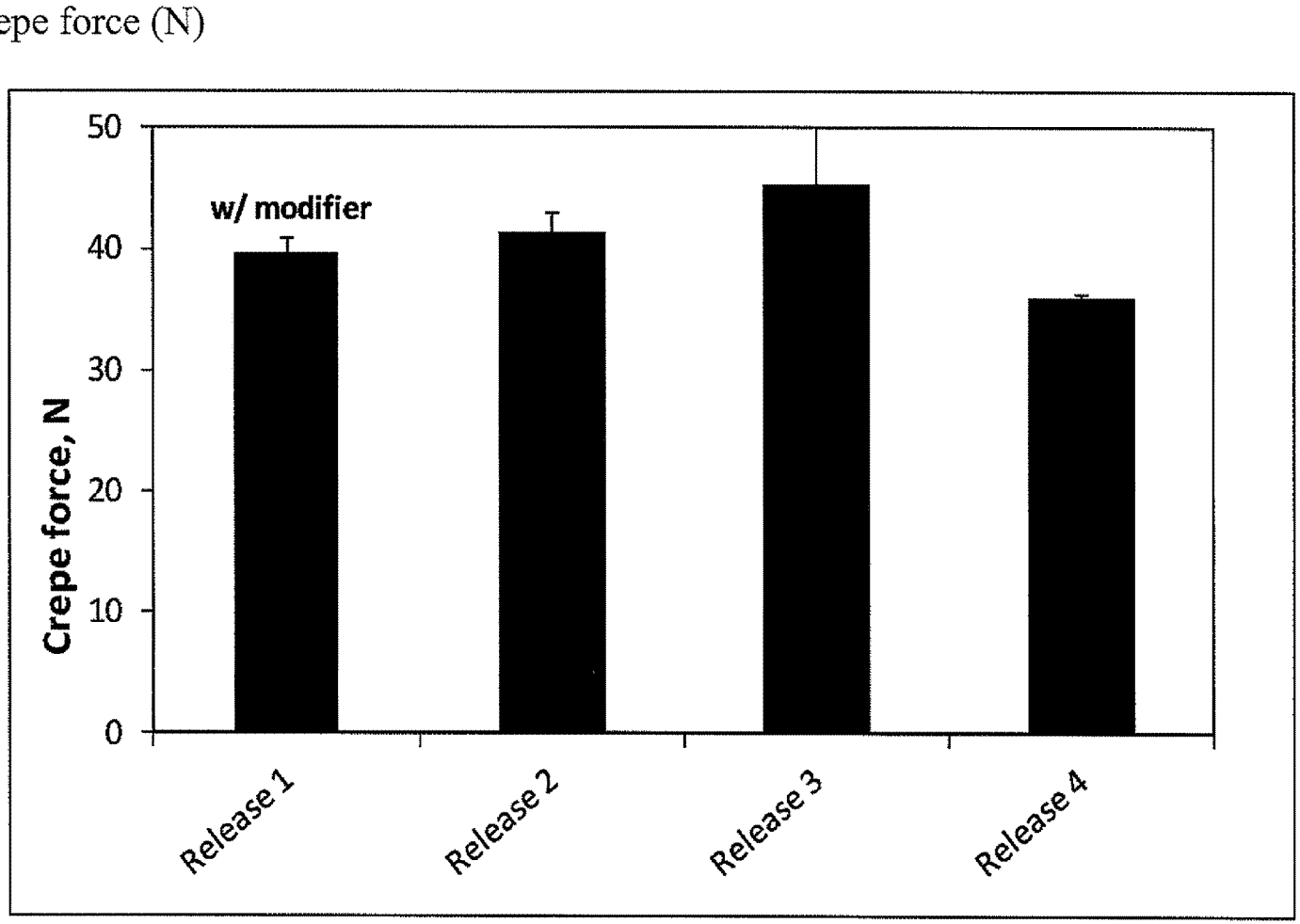
FIG. 2, show results of crepe force (N)
Figure 3:
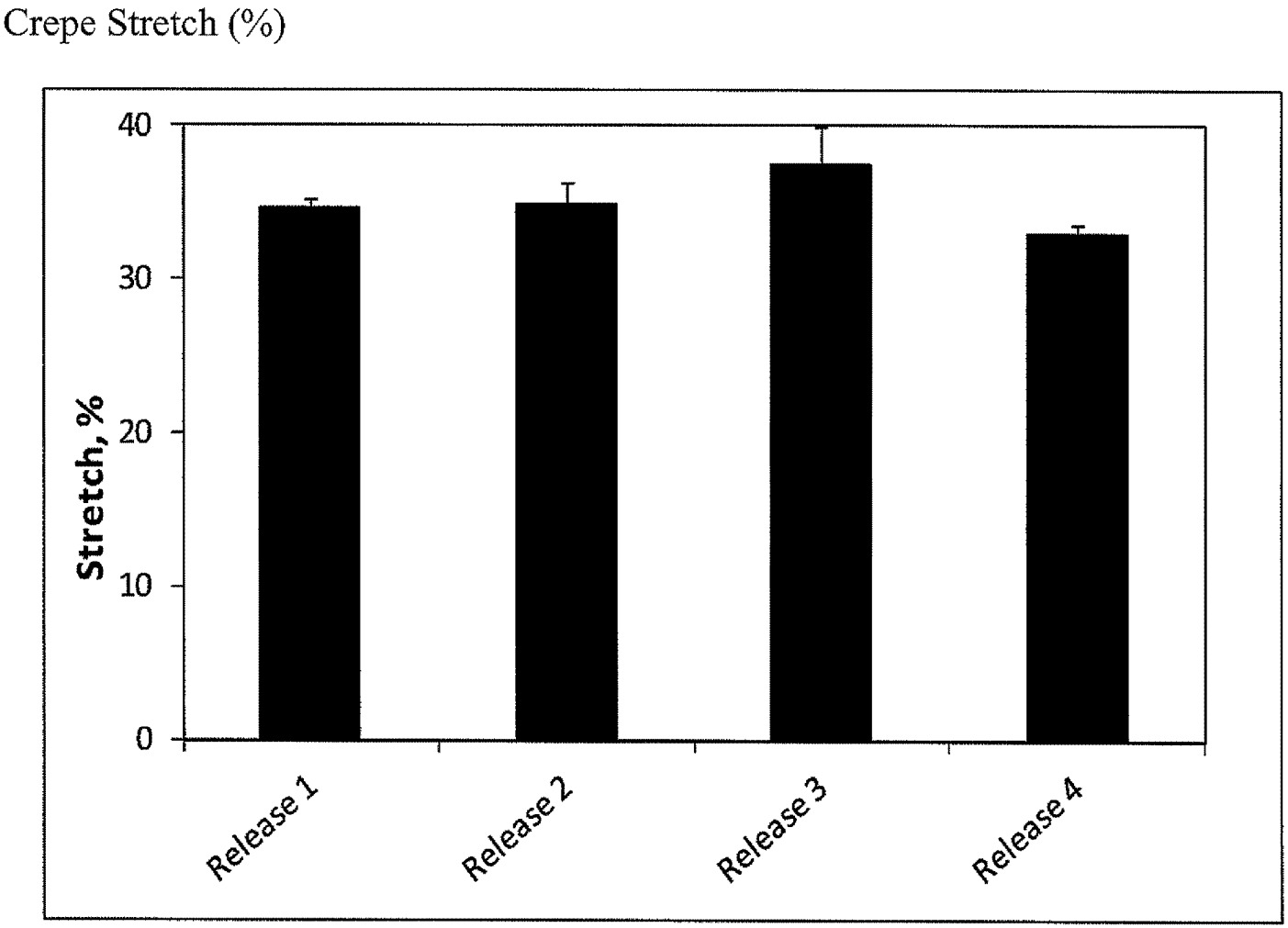
FIG. 3, shows results of crepe stretch (%)
Figure 4:
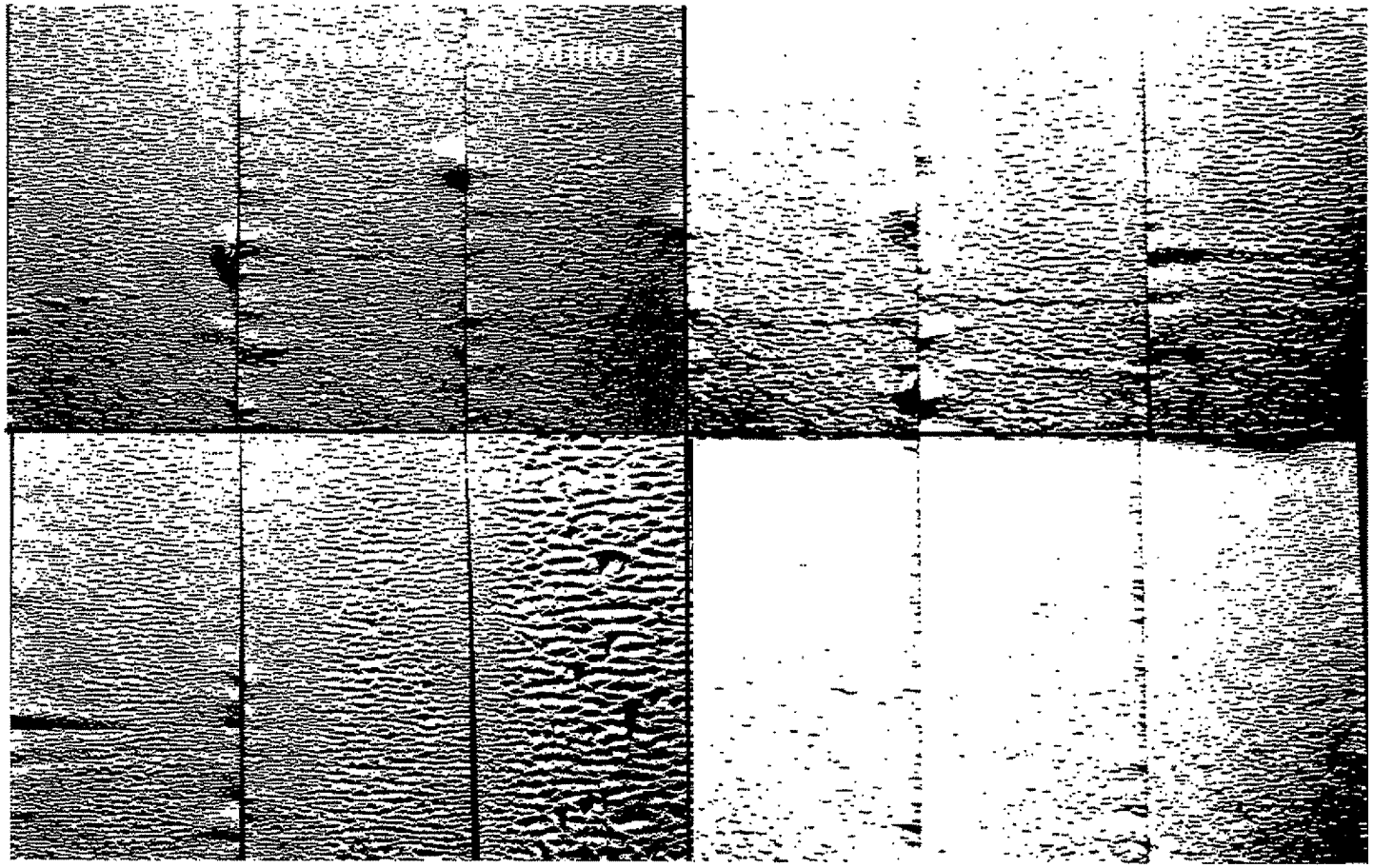
FIG. 4, is a photomicrograph of the surface of the crepe paper.

Table 4, FIG. 2 and FIG. 3, summarize creping evaluation results at 100° C. The crepe simulator test results demonstrate that the micro-emulsion of release agent and modifier agent using high pressure and high mechanical energy provided lower sheet crepe ratio and lower creping force. Surface photographs shown in FIG. 4, shows that the micro-emulsion of release agent and modifier agent (Release 4) not only improved crepe structure by generating finer crepes but also improved handfeel. The results indicated that the micro-emulsion of release and modifier agent provided higher effectiveness compared with mixing the release agent and modifier component together right before the spray (i.e. normal emulsion techniques).

Example #3

Benefits of the Micro-Emulsion of Release and Modifier Agent

The compositions shown in Tables 5 and 6, were evaluated under two different methods of product preparation for their efficiency of reducing creping adhesion during creping operation.

TABLE 5

| Compositions of creping aid system | | | |
|---|---|---|---|
| Example | Adhesive | Release | Modifier |
| 1 | Crepetrol 9730 | Rezosol 4119 | Yes |
| 2 | Crepetrol 9730 | #1 Emulsified | No |
| 3 | Crepetrol 9730 | #1 Blended | No |
| 4 | Crepetrol 9730 | #2 Emulsified | No |
| 5 | Crepetrol 9730 | #2 Blended | No |
| 6 | Crepetrol 9730 | Rezosol 4119 | Yes - Micro-emulsion |

#1 Emulsified is micro-emulsion of release and modifier agents with high shear and high mechanical energy, that is identical to Release 4 in Examples 1 and 2. #1 Blended is pre-blended product with rigorous mixing whose components are identical to #1 Emulsified.

#2 Emulsified is a micro-emulsion of release and modifier agents with high shear and high mechanical energy. Composition of #2 Emulsified, is similar to #1 Emulsified, but used mineral oil as a major hydrophobic material. #2 Blended, is pre-blended product with rigorous mixing whose components are identical to #2 Emulsified.

TABLE 5

| Crepe performance results of creping aid system. | | | | | | | |
|---|---|---|---|---|---|---|---|
| | | | | Stretch (%) | | Crepe Force (N) | |
| Ex. | Adhesive | Release | Modifier | Average | S | Average | S |
| 1 | Crepetrol 9730 | Rezosol 4119 | Yes | 33.75 | 2.17 | 52.15 | 1.48 |
| 2 | Crepetrol 9730 | #1 Emulsified | No | 30.00 | 0.00 | 40.17 | 0.76 |
| 3 | Crepetrol 9730 | #1 Blended | No | 32.08 | 2.60 | 45.60 | 3.43 |
| 4 | Crepetrol 9730 | #1 Emulsified | No | 29.17 | 1.44 | 39.70 | 0.84 |
| 5 | Crepetrol 9730 | #1 Blended | No | 37.08 | 0.72 | 54.58 | 1.10 |
| 6 | Crepetrol 9730 | Rezosol 4119 | Yes-Micro-emulsion | 35.00 | 2.50 | 55.62 | 0.36 |

Figure 5:
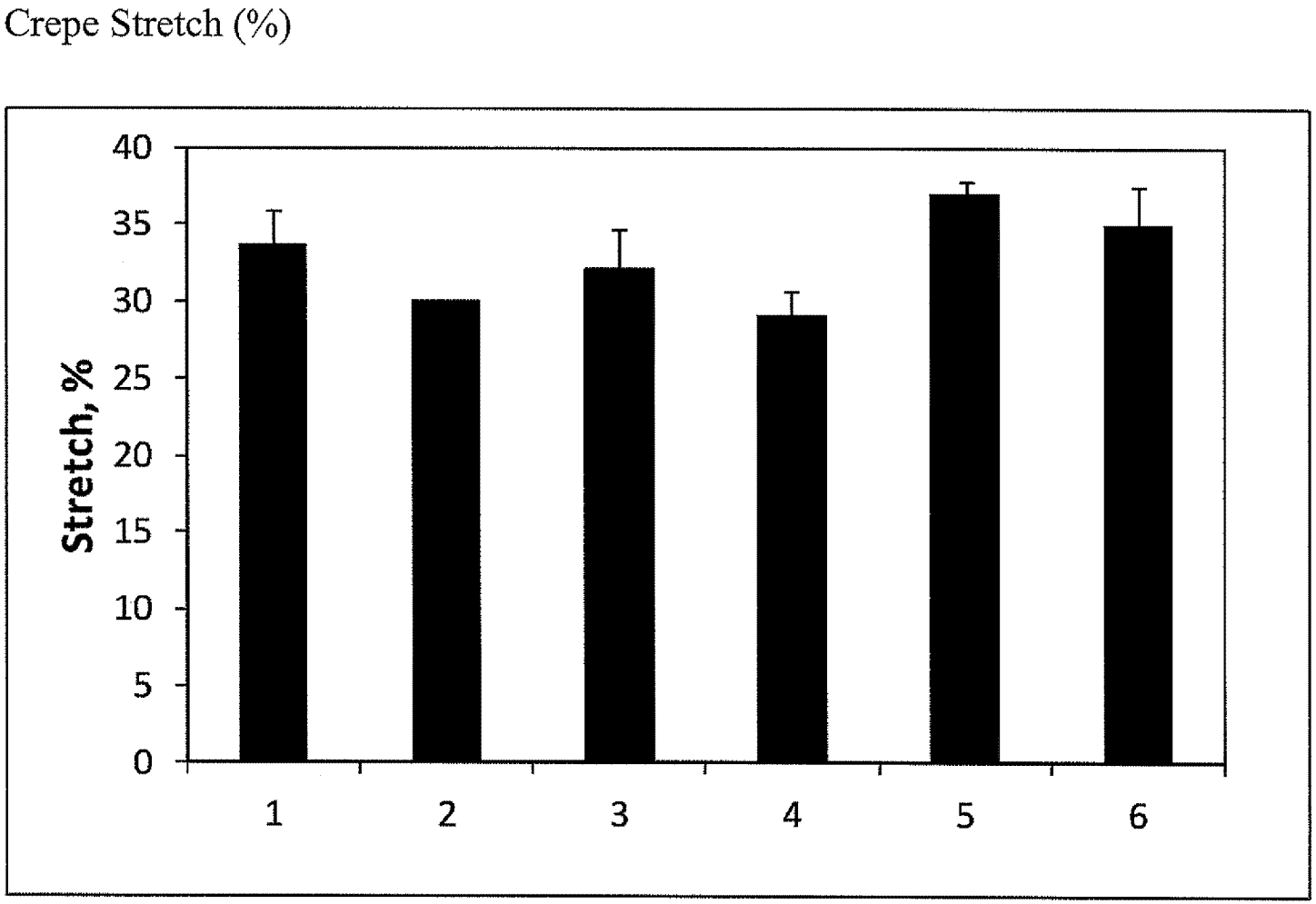
FIG. 5, shows results of crepe stretch (%)
Figure 6:
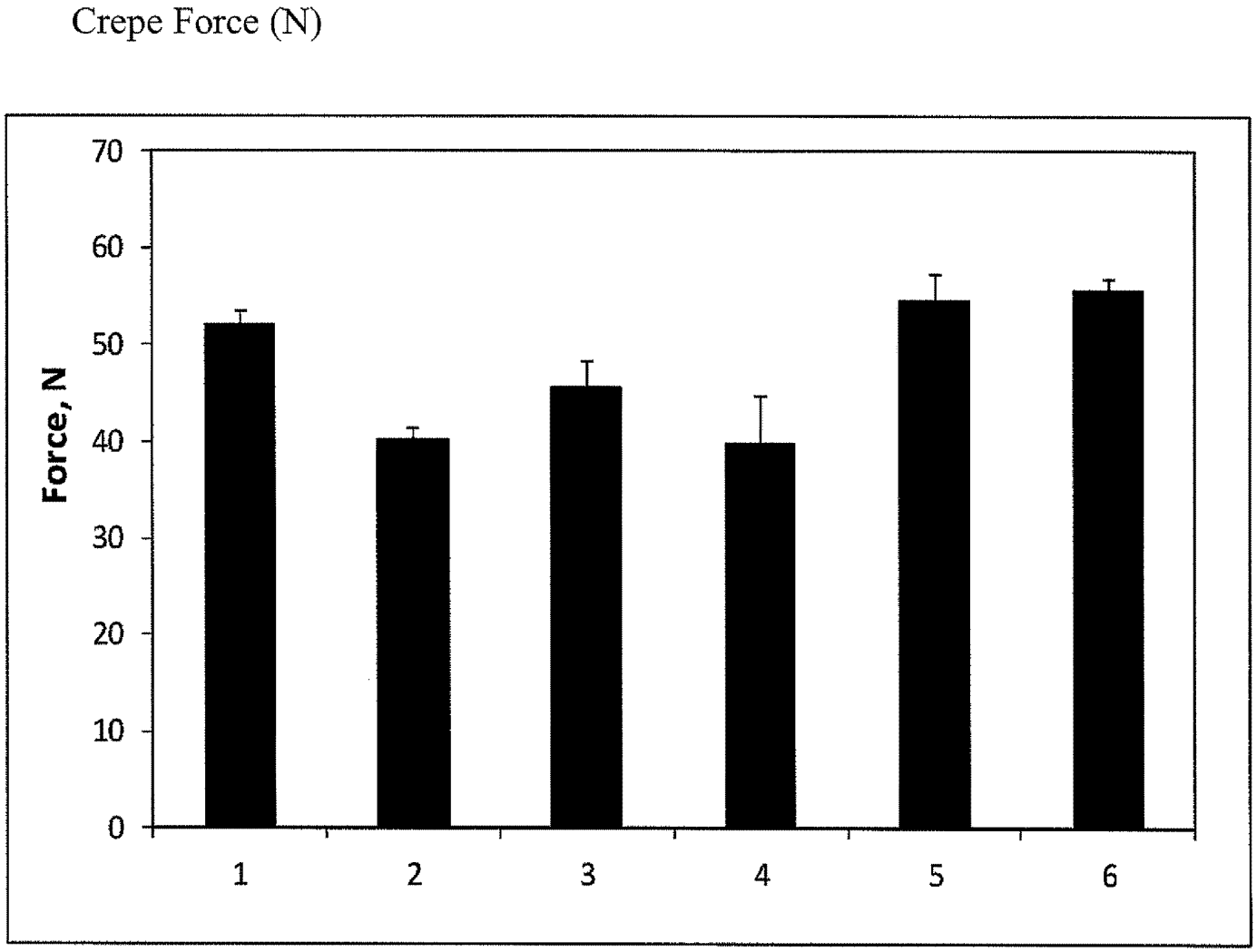
FIG. 6, show results of crepe force (N)

Table 5, and FIGS. 5 and 6, summarize creping evaluation results at 100° C. Crepe simulator test results also shows that the micro-emulsion of release and modifier agent (#1 and #2 Emulsified) using high pressure and high mechanical energy provided lower sheet crepe ratio and lower creping force than that of pre-blended products (#1 and #2 Blended). The results indicated that the micro-emulsion of release and modifier agent with high pressure and high shear were more effective than the pre-blended products or two component mixed right before the application.

We claim:

1. A method for manufacturing a crepe paper having improved release properties comprising:

preparing a water-based micro-emulsion having a mean particle size of less than about 1 micron comprising at least one release agent and at least one modifier agent; wherein the release agent and modifier agent are homogenized separately and then combined or combined and then homogenized, producing a micro-emulsion;

applying the micro-emulsion to the surface of a crepe fiber web, the surface of a Yankee cylinder, or a combination thereof; with one or more adhesives and optionally one or more plasticizers; and producing a crepe paper product.

2. The method of claim 1, wherein the release agent and modifier agent are homogenized separately and then combined to produce the micro-emulsion.

3. The method of claim 1, wherein the adhesive and optional plasticizer are combined with the release agent and modifier agent prior to the release agent and modifier agent being homogenized.

4. The method of claim 1, wherein the adhesive(s) and optional plasticizer(s) is applied to the surface of the crepe fiber web or Yankee cylinder prior to the micro-emulsion, can be applied simultaneously with the micro-emulsion, can be applied subsequent to the micro-emulsion, or in any combination thereof.

5. The method of claim 1, wherein the release agent and modifier agent micro-emulsion comprises one or more compounds selected from the group consisting of hydrophobic materials, nonionic surfactants, anionic surfactants, and mixtures of thereof.

6. The method of claim 1, wherein the hydrophobic materials are selected from the group consisting of mineral oil, vegetable oil, fatty acid esters, natural or synthetically derived hydrocarbon, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, polyethylene homopolymers, oxidized polypropylene homopolymers, and oxidized polyethylene homopolymers.

7. The method of claim 1, wherein the micro-emulsion comprising fatty acid tri-ester, synthetically derived hydrocarbon, anionic surfactant, linear ethoxylated alcohol and combinations thereof.

8. The method of claim 1, wherein the micro-emulsion comprises a fatty acid tri-ester in a concentration of from about 30% to about 99% by wt. of the micro-emulsion.

9. The method of claim 1, wherein the micro-emulsion comprises a synthetically derived hydrocarbon in a concentration of from 0% to about 90% by wt. of the micro-emulsion.

10. The method of claim 1, wherein the micro-emulsion is a mixture comprising at least two of a mineral oil, synthetically derived hydrocarbon, anionic surfactant and/or linear ethoxylated alcohol.

11. The method of claim 1, wherein the micro-emulsion comprises a least one nonionic surfactant selected from the group selected from linear alcohol ethoxylated, branched alcohol ethoxylated, polyethylene glycol mono or diester fatty acid, polyethylene glycol alkyl ether and combinations thereof.

12. The method of claim 1, wherein composition comprises a least one anionic surfactant selected from the group consisting of sodium dioctylsulfosuccinate, sodium dodecylbenzenesulfonate, sodium lauryl sulfate and combinations thereof.

13. The method of claim 1, wherein the creping adhesive is selected from the group consisting of a thermosetting resin, a non-thermosetting resin, a polyamide resin, a polyaminoamide resin, polyvinylamine, a glyoxylated polyacrylamide resin, a film-forming semi-crystalline polymer, hemicellulose, carboxymethyl cellulose, polyvinyl alcohol, an inorganic cross-linking agent and combinations thereof.

14. The method of claim 1, wherein the release efficiency of the crepe paper from the Yankee cylinder is improved by at least about 10% when compared with a similar composition wherein the release agent and modifier agent are not homogenized into a micro-emulsion.

15. The method of claim 1, wherein the creping adhesive, optional plasticizer and micro-emulsion of release and modifier agents are mixed before applying to the surface of the crepe fiber web and/or Yankee dryer.

16. The method of claim 1, wherein the creping adhesive and the micro-emulsion of release and modifier agents are applied separately to the surface of the crepe fiber web and/or Yankee dryer.

17. The method of claim 1, wherein the micro-emulsion of release agent and modifier agent and/or creping adhesive is first applied to the fibrous web, and wherein the micro-emulsion of release and modifier agent and/or creping adhesive is transferred to the surface of the Yankee dryer on pressing the fibrous web against the surface of the Yankee dryer.

18. The method of claim 1, wherein the micro-emulsion has a mean particle size of about 500 nm or less.

19. The method of claim 1, wherein the micro-emulsion has a mean particle size of about 300 nm or less.

* * * * *